US007430380B2

(12) United States Patent
Hamby et al.

(10) Patent No.: US 7,430,380 B2
(45) **Date of Patent: *Sep. 30, 2008**

(54) PRINTING SYSTEM

(75) Inventors: Eric Scott Hamby, Fairport, NY (US); Kristine A. German, Webster, NY (US); Robert M. Lofthus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 351 days.

This patent is subject to a terminal disclaimer.

(21) Appl. No.: 11/234,468

(22) Filed: Sep. 23, 2005

(65) Prior Publication Data

US 2007/0071465 A1 Mar. 29, 2007

(51) Int. Cl.
*G03G 15/00* (2006.01)
*G03G 15/20* (2006.01)

(52) U.S. Cl. ..... 399/45; 399/67

(58) Field of Classification Search ..... 399/2, 399/45, 67, 68, 69, 82, 107, 122, 79, 320, 399/322, 328, 341, 400, 401, 407
See application file for complete search history.

(56) References Cited

U.S. PATENT DOCUMENTS 4,579,446 A 4/1986 Fujino et al.
4,587,532 A 5/1986 Asano
4,591,884 A 5/1986 Miyamoto et al.
4,791,447 A 12/1988 Jacobs
4,836,119 A 6/1989 Siraco et al.
4,928,148 A 5/1990 Higashi
5,004,222 A 4/1991 Dobashi
5,019,869 A 5/1991 Patton
5,053,828 A 10/1991 Ndebi et al.
5,080,340 A 1/1992 Hacknauer et al.
5,095,342 A 3/1992 Farrell et al.
5,159,395 A 10/1992 Farrell et al.
5,208,640 A 5/1993 Horie et al.
5,241,155 A 8/1993 Koh et al.
5,258,809 A 11/1993 Wiedemer (Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David M. Gray
*Assistant Examiner*—Andrew V Do
(74) *Attorney, Agent, or Firm*—Eugene O. Palazzo; Fay Sharpe LLP

(57) ABSTRACT

A printing system includes first and second marking engines in series which each include an image applying component for applying an image to print media and a fixing device for at least partially fixing the applied image. One or both marking engines are operable in first and second modes of operation. In the first mode, the fixing device at least partially fixes the image applied by the respective image applying component. In the second mode, the fixing device is used to further fix an image on the print media which has been applied by the image applying component of the other marking engine without an intermediate application of an image to the print media by the second image applying component. A processing component controls the marking engine to operate in a selected one of the first and second modes of operation.

21 Claims, 3 Drawing Sheets

U.S. PATENT DOCUMENTS 5,272,511 A 12/1993 Conrad et al.
5,296,904 A 3/1994 Jackson
5,326,093 A 7/1994 Sollitt
5,435,544 A 7/1995 Mandel
5,459,561 A 10/1995 Ingram
5,473,419 A 12/1995 Russel et al.
5,489,969 A 2/1996 Soler et al.
5,504,568 A 4/1996 Saraswat et al.
5,506,671 A 4/1996 Buts et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,678,133 A 10/1997 Siegel
5,710,968 A 1/1998 Clark et al.
5,778,377 A 7/1998 Marlin et al.
5,848,331 A 12/1998 Fromm
5,884,910 A 3/1999 Mandel
5,890,032 A 3/1999 Aslam et al.
5,918,089 A 6/1999 Malinich et al.
5,995,721 A 11/1999 Rourke et al.
6,016,409 A 1/2000 Beard et al.
6,059,284 A 5/2000 Wolf et al.
6,088,565 A 7/2000 Jia et al.
6,097,500 A 8/2000 Fromherz
6,101,345 A 8/2000 Van Goethem et al.
6,101,364 A 8/2000 Boehmer et al.
6,125,248 A 9/2000 Moser
6,212,357 B1 4/2001 Boehmer et al.
6,241,242 B1 6/2001 Munro
6,297,886 B1 10/2001 Cornell
6,341,773 B1 1/2002 Aprato et al.
6,384,918 B1 5/2002 Hubble, III et al.
6,393,245 B1 5/2002 Jia et al.
6,450,711 B1 9/2002 Conrow
6,476,376 B1 11/2002 Biegelsen et al.
6,476,923 B1 * 11/2002 Cornell ..... 358/1.12
6,493,098 B1 12/2002 Cornell
6,512,914 B2 1/2003 Kabashima
6,532,351 B2 3/2003 Richards et al.
6,537,910 B1 3/2003 Burke et al.
6,550,762 B2 4/2003 Stoll
6,554,276 B2 4/2003 Jackson et al.
6,577,925 B1 6/2003 Fromherz
6,600,895 B2 7/2003 Fletcher et al.
6,607,320 B2 8/2003 Bobrow et al.
6,608,988 B2 8/2003 Conrow
6,612,566 B2 9/2003 Stoll
6,612,571 B2 9/2003 Rider
6,618,167 B1 9/2003 Shah
6,621,576 B2 9/2003 Tandon et al.
6,626,110 B1 9/2003 Keller
6,633,382 B2 10/2003 Hubble, III et al.
6,639,669 B2 10/2003 Hubble, III et al.
6,647,239 B2 11/2003 Oberhoffner
6,654,136 B2 11/2003 Shimada
6,661,993 B2 12/2003 Bartscher et al.
6,671,486 B1 12/2003 Fletcher
6,682,237 B2 1/2004 Cocklin et al.
6,744,527 B1 6/2004 Dorsey et al.
6,819,906 B1 11/2004 Herrmann et al.
6,853,832 B2 2/2005 Noya
6,895,191 B2 5/2005 Rommelmann et al.
6,925,283 B1 8/2005 Mandel et al.
6,980,762 B2 12/2005 Bogoshian
7,024,149 B2 4/2006 Kito
7,072,610 B2 7/2006 Nakawe
7,197,271 B2 3/2007 Nakamura et al.
7,226,158 B2 6/2007 Moore et al.
7,245,844 B2 * 7/2007 de Jong et al. ..... 399/69
2002/0078012 A1 6/2002 Ryan et al.
2002/0103559 A1 8/2002 Gartstein
2002/0191992 A1 12/2002 Funato
2003/0077095 A1 * 4/2003 Conrow ..... 399/364
2003/0180063 A1 9/2003 Kanesawa et al.
2003/0228181 A1 12/2003 Fletcher
2004/0081489 A1 4/2004 Noya et al.
2004/0085561 A1 5/2004 Fromherz
2004/0085562 A1 5/2004 Fromherz
2004/0088207 A1 5/2004 Fromherz
2004/0096250 A1 5/2004 Kito et al.
2004/0114976 A1 6/2004 Weber et al.
2004/0150156 A1 8/2004 Fromherz et al.
2004/0150158 A1 8/2004 Biegelsen et al.
2004/0153983 A1 8/2004 McMillan
2004/0155395 A1 8/2004 Milillo et al.
2004/0179201 A1 9/2004 Schneider et al.
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2005/0025540 A1 2/2005 Murai et al.
2005/0135847 A1 6/2005 Bogoshian
2005/0158089 A1 * 7/2005 Amarakoon ..... 399/341
2006/0034631 A1 2/2006 Lofthus et al.
2006/0067757 A1 3/2006 Anderson et al.
2006/0114313 A1 6/2006 Moore
2006/0115305 A1 6/2006 Lofthus
2006/0115306 A1 * 6/2006 Lofthus et al. ..... 399/341
2006/0221362 A1 * 10/2006 Julien ..... 358/1.4
2006/0222393 A1 * 10/2006 de Jong et al. ..... 399/67
2006/0290760 A1 12/2006 German et al.

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/002,528, filed Dec. 2, 2004, Lofthus et al.

U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.

* cited by examiner

PRINTING SYSTEM

CROSS REFERENCE TO RELATED PATENTS AND APPLICATIONS

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N.M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. dejong, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Mandel et al.; and U.S. application Ser. No. 11/170,845, filed Jun. 30, 2005, entitled "HIGH AVAILABILITY PRINTING SYSTEMS," by Meera Sampath et al.

BACKGROUND

The present exemplary embodiment relates generally to fusing of images in a printing system including a plurality of marking engines. It finds particular application in conjunction with a printing system which includes first and second tandem marking engines where the second marking engine receives print media which has been partially fused by the fuser of the first marking engine, and will be described with particular reference thereto. However, it is to be appreciated that the present exemplary embodiment is also amenable to other like applications.

In a typical xerographic marking engine, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto the paper is generally accomplished by applying heat to the tonerwith a heated roller and application of pressure.

Systems which incorporate several marking engines have been developed. These systems enable high overall outputs to be achieved by printing portions of the same document on multiple printers. Such systems are commonly referred to as "tandem engine" printers, "parallel" printers, or "cluster printing" (in which an electronic print job may be split up for distributed higher productivity printing by different printers, such as separate printing of the color and monochrome pages). Tandem engine printing systems allow a sheet of print media to be printed by a first marking engine and then conveyed by a paper pathway to a second marking engine. This permits "tandem duplex printing." In this process, a first marking engine applies an image to a first side of a sheet and a second marking engine applies an image to a second side of the sheet. Each of the marking engines is thus operating in a simplex mode to generate a duplex print.

Such integrated printing systems have advantages over more complex, single marking engine systems in that they can achieve high productivity by combining several relatively low-cost smaller marking engines. However, the smaller marking engines frequently do not have the capability to fuse a wide range of print substrates or may run at lower outputs, in terms of prints per minute, when certain heavyweight media is to be fused.

INCORPORATION BY REFERENCE

The following references are totally incorporated herein in their entireties, by reference:

U.S. Pat. No. 6,925,283 issued Aug. 2, 2005, entitled "HIGH PRINT RATE MERGING AND FINISHING SYSTEM FOR PARALLEL PRINTING," by Barry P. Mandel, et al. discloses a media path system operable to transport printed media from two or more marking engines to one or more finishing stations such that the streams are merged and transported one on top of the other.

US 2005/0135847 published Jun. 23, 2005, entitled "MODULAR MULTI-STAGE FUSING SYSTEM," by Gregory V. Bogoshian discloses a multi-stage fusing system for fixing toner images to copy substrates of various weights.

BRIEF DESCRIPTION

In aspects of the exemplary embodiment, a printing system and a method of printing are provided. In one aspect, the printing system includes a first marking engine including a first image applying component for applying an image to print media and a first fixing device for at least partially fixing the image applied by the first image applying component. A second marking engine is in series with the first marking engine. The second marking engine comprises a second image applying component and a second fixing device. The second marking engine being operable in a first mode of operation in which the second image applying component applies an image to print media and the second fixing device at least partially fixes the image applied by the second image applying component. The second marking engine is also operable in a second mode of operation in which the second fixing device further fixes an image on the print media which has been applied by the first image applying component and fixed by the first fixing device without an intermediate application of an image to the print media by the second image applying component. A processing component controls the second marking engine to operate in a selected one of the first and second modes of operation.

In another aspect, a method of marking print media includes applying an image to print media with a first image applying component and at least partially fixing the image with an associated first fixing device. The applied and at least partially fixed image is further fixed with a second fixing device associated with a second image applying component configured for selectively applying images to print media, without an intermediate application of an image to the print media by the second image applying component.

In another aspect, a printing system includes a first marking engine comprising a first image applying component for applying an image to print media and a first fixing device for at least partially fixing the image applied by the first image applying component. A second marking engine is in series with the first marking engine. The second marking engine includes a second image applying component for applying an image to print media and a second fixing device for at least partially fixing the image applied by the second image applying component. A bypass pathway is provided whereby the second image applying component is selectively bypassed for further fixing an image on the print media which has been applied by the first image applying component and fixed by the first fixing device.

DETAILED DESCRIPTION

Figure 1:
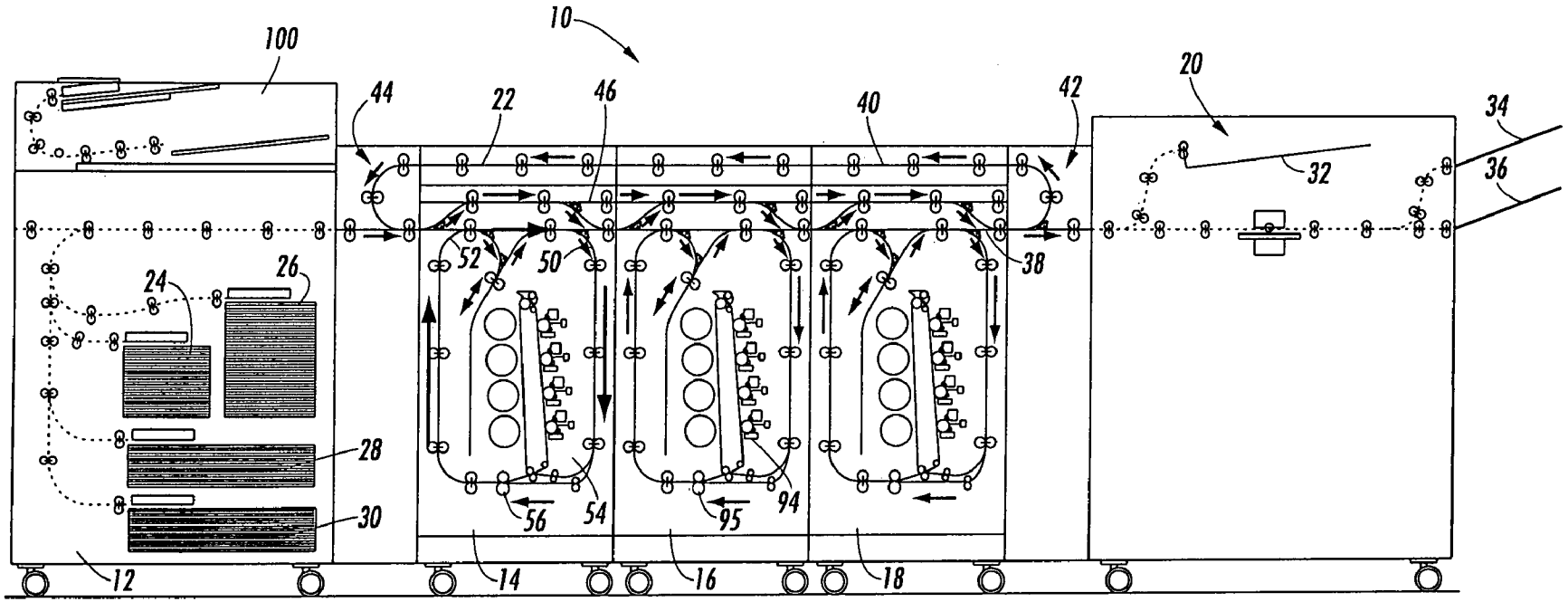
FIG. 1 is a schematic side view of a printing system according to one aspect of the exemplary embodiment.

Printing systems having multiple marking engines provide a wide range of printing capabilities with high reliability and often have excess capacity so that urgent print jobs can be handled efficiently. During normal operation, typically fewer than all the marking engines of such a printing system are occupied in printing print media. The present exemplary embodiment enables the excess capacity of such a system to be utilized to provide a secondary fusing of print media which has been only partially fused in one of the operational marking engines.

Aspects of the exemplary embodiment relate to a printing system comprising first and second marking engines in series, each with an image applying component for applying images to print media. A fixing device is associated with each marking engine. In one mode of operation, the image applying component of the second making engine can by bypassed to enable media which has been fixed by the first fixing device to be further fixed by the second fixing device without intermediate application of a second image to the print media. For example, a print media conveyor system includes a first pathway for conveying print media to the second image applying component and a second pathway which allows print media to bypass the second image applying component. Alternatively, the image applying component may be dissociated from the conveyor system when not in use. The print media can be conveyed between the first and second fixing devices by a print media conveyor. In another aspect, a control system selects fused images forfurther fixing and routes them to the fixing device associated with an otherwise unoccupied second marking engine for further fixing.

The exemplary printing system allows a marking engine which is not being used for marking images to be utilized for applying the further fixing treatment. The further fixing treatment can be used to reduce the requirements on the first fixing device by allowing the first fixing device to effect only a partial fixing. The further fixing treatment may be used to increase image permanence (attachment of the image), to modify image appearance (gloss), or both.

The exemplary printing system may have an improved print media latitude, for example, enabling heavy weight paper which is outside the normal latitude limits of any of the individual marking engines to be printed and fixed. Alternatively, print media which is within the latitude limits of an individual marking engine but which is normally run at slower speeds can be handled at higher productivity. In another aspect, the printing system takes advantages of particular attributes of the second fixing device which may be temporarily or permanently lacking in the first fixing device to achieve particular fixing characteristics. For example, the secondary fixing device may have a capacity for higher gloss than the first fixing device. The control system may access a model of the machine which includes information on the capabilities of each of the fixing devices in the printing system such that an appropriate secondary fixing device from a plurality of available secondary fixing devices may be selected which best satisfies desired fixing characteristics of a print job or which is best suited for handling a selected print media.

Print media which has been fixed by a first fixing device may have residual heat when it arrives at a second fixing device. The second fixing device may be set at a lower temperature to compensate for the residual heat. A model of the print media temperature upon arrival at the second fixing device may be used by a processing system of the printing system to adjust the operating temperature of the second fixing device.

The image applying components of the two marking engines used for primary and secondary fixing can be of the same or of different print modalities, e.g., both monochrome (black or custom color), both process color (multicolor, such as CMYK), or one of each. Thus, a color image may receive its second fixing by the fixing device of a black marking engine, or vice versa, although in general, a second fixing is performed by a marking engine of the same print modality, since the operating conditions are generally better matched for the marking material.

In another aspect a method of marking includes marking print media with a first marking engine and applying a fixing treatment to the image with an associated fixing device. A further fixing treatment is applied to the marked print media by a fixing device associated with a second marking engine. In one aspect, a processing component directs the print media to a bypass pathwayfor bypassing an image applying component of the second marking engine.

The terms "marking engine" and "printer," are used interchangeably to refer to a device for applying an image to print media. "Print media" can be a usually flimsy physical sheet of paper, plastic, or other suitable physical print media substrate for images, whether precut or web fed. The printing system may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related.

The printing system may incorporate "tandem engine" printers, "parallel" printers, "cluster printing," "output merger," or "interposer" systems, and the like, as disclosed, for example, in U.S. Pat. Nos. 4,579,446; 4,587,532; 5,326,093; 5,489,969 5,568,246; 5,570,172; 5,596,416; 5,995,721; 6,554,276, 6,654,136; 6,607,320, and in above-mentioned application Serial Nos. 10/924,459 and 10/917,768, the disclosures of which are totally incorporated herein by reference. A tandem engine printing system feeds paper from a common paper stream to a plurality of printers in series, which may be horizontally and/or vertically stacked. Printed media from the various printers is then taken from the printers to a finisher where the sheets associated with a single print job are assembled.

With reference to FIG. 1, an exemplary printing system 10 for effecting a dual fusing of an image is illustrated. The printing system may be a printer, copier, or a multifunction device having both printing and copying capabilities. The illustrated printing system is a modular system and includes a plurality of processing units, such as a print media source 12, a plurality of marking engines 14, 16, 18, and an output destination 20, such as a finisher. The processing units 12, 14, 16, 18, and 20 are all interconnected by a print media conveyor 22. In some embodiments, one or more of the processing units 12, 14, 16, 18, 20 are removable processing units. For example, the functional portion of a processing unit may be removed, leaving only the external housing or mounting fixture through which the print media conveyor 22 passes. In this manner, for example, the functional portion can be removed for repair, or can be replaced to effectuate an upgrade or modification of the printing system 10.

The printing system 10 executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 10 are determined by the capabilities of the paper source 12, marking engines 14, 16, 18, and finisher 20 of the printing system 10. These capabilities may increase over time due to addition of new processing units or upgrading of existing processing units. The capabilities may also decrease overtime due to failure or removal of one or more processing units.

While three marking engines 14, 16, 18 are illustrated, the number of marking engines can be two, three, four, five, six, or more. Marking tasks can be distributed amongst the at least two marking engines. Some or all of the marking engines 14, 16, 18 may be identical to provide redundancy or improved productivity through parallel printing. Alternatively or additionally, some or all of the marking engines 14, 16, 18 may be of different modalities to provide different capabilities. Thus, while three multi-color (process color, P) marking engines are illustrated, one or more of the marking engines 14, 16, 18 may be a monochrome engine, such as a black (K) marking engine or a custom color (C) marking engine.

The illustrated marking engines 14, 16, 18 employ xerographic printing technology, in which an electrostatic image is formed and coated with a toner material, and then transferred and fused to paper or another print medium by application of heat and/or pressure. However, marking engines employing other printing technologies can be provided as processing units, such as marking engines employing ink jet transfer, thermal impact printing, or the like.

The illustrated print media source 12 is a high capacity feeder which includes print media sources 24, 26, 28, 30, such as trays, which are connected with the print media conveyor 22 to provide selected types of print media to all of the marking engines. While four print media sources are illustrated, the number of print media sources can be one, two, three, four, five, or more. In other embodiments, one or more of the marking engines may include its own dedicated print media source. Each of the print media sources 24, 26, 28, 30 can store sheets of the same type of print medium, or can store different types of print media. The print media can be substantially any type of medium upon which one or more of the marking engines 12, 14, 16 can print, such as: high quality bond paper, lower quality "copy" paper, overhead transparency sheets, high gloss paper, heavy weight paper and card, and the like. A given marking engine 12, 14, 16 may be able to print and fix one type of print media without slowing from its normal (e.g., maximum) operating speed while for another type of print media, only a partial fixing is effected when the marking engine is run at a normal operating speed. While the marking engine may be able to accommodate these media by slowing, this affects the productivity of the printing system. In such cases, a secondary fixing operation in a separate marking engine allows the first marking engine to maintain normal operating speed.

For example, print media source 24 may store a first weight paper such as letter size paper weighing 75 gsm, print media source 26 may store a second weight paper such as letter size paper weighing 90 gsm, print media source 28 may store a third weight paper such as letter size paper weighing 120 gsm, and print media source 30 may store a fourth weight paper or card such as letter size paper weighing 300 gsm.

Depending on the capabilities of the marking devices, these weights may be considered normal or heavyweight. In an exemplary embodiment, the print media in sources 24 and 26 is normal paper for all the color marking engines, i.e., the marking engines 14, 16 and 18 can print on these media types under normal operating conditions, without slowing. The print media in source 28 may be utilized if the marking engine is run at a slower speed or if a further fixing treatment is applied. The print media in source 30 may be outside the fixing capabilities of any of the color marking engines, even when run at a slower than normal speed, and in order to fix such media, a secondary fixing treatment is applied.

The print media conveyor 22 is controllable to acquire sheets of a selected print medium from the print media sources 24, 26, 28, 30, transfer each acquired sheet to one or more of the installed marking engines 14, 16, 18 to perform selected marking tasks, and then transfer each sheet to the finisher 20 to perform finishing tasks. The finisher unit 20 includes one or more print media output destinations, 32, 34, 36, herein illustrated by trays. While three output destinations 32, 34, 36 are illustrated, the printing system 10 may include one, two, three, four, or more print media output destinations.

The print media conveyor 22 includes a plurality of paper paths and associated drive elements, such as rollers, spherical balls, or air jets, which convey the print media along the paths and may include diverters, inverters, interposers, and the like, as known in the art. The paths may be in the form of loops which allow print media from one marking engine to be delivered to another marking engine for duplex printing (two sided printing) or overprinting (printing on the same side of the sheet). In the illustrated printing system 10, print media which has been printed by one marking engine can be routed to any other marking engine. Additionally, bypass pathways allow any one or more of the marking engines to be bypassed. In other configurations (not shown) the routing may be more limited. In the exemplary embodiment, main downstream and upstream highways 38, 40, respectively, are connected at ends thereof by junctions 42, 44, while a second, optional downstream highway 46 is accessible from the first downstream highway 38 for bypassing one or more of the marking engines 14, 16, 18. Branch pathways 50, 52 connect the main downstream highway 38 with respective ones of the marking engines. While the illustrated marking engines are aligned in a linear arrangement, it is also contemplated that they may be stacked in a two or three dimensional configuration.

At least one paper source 24, 26, 28, 30 is connected by the conveyor 22 with at least two marking engines of the same type, such as process color marking engines 14, 16, and 18. In a first mode of operation, a print job or jobs employing the paper can be selectively distributed to two or more of the marking engines 14, 16, 18 for parallel printing (two or more marking engines each performing part of a print job) or to two or more marking engines in series for duplex printing or overprinting. In this mode, both marking engines apply and fix an image. In a second mode of operation, print media marked and fixed by a first of the marking engines 14, 16, 18 is conveyed to a second of the marking engines 14, 16, 18 for a further fixing without marking. The printing system may be capable of operating in both these modes contemporaneously or during a single print job, depending on the number of available marking engines. For example, marking engine 18 may be simplex printing a first portion of a print job on normal weight paper while marking engines 14 and 16 operate in series to simplex print and fix, then further fix heavy weight media.

For higher basis weight print media, where a marking engine does not adequately fix the image at normal operating speeds, the first fixing device may perform a partial fixing adequate to at least tack the image to the sheet, with the second fixing device completing the fixing to achieve long term image permanence. While printing of heavy paper weight is used as an example of an application to which the dual fusing mode is suited, it will be appreciated that other properties of the print media, such as surface texture and coatings, and properties of the image, such as toner pile height and area coverage may, in some instances, also benefit from the dual fusing mode in extending the capabilities of the printing system or its productivity. In the case of rough stock, the toner may adhere poorly to crevices in the paper surface and the flow of toner may be insufficient. A further fixing tends to improve adherence. For coated papers, a higher gloss may be desired is that the image meets the gloss of the surrounding page. This can be achieved in the secondary fixing.

In the illustrated embodiment, any of the marking engines can be used as a second fixing device for applying a further fixing to a print media image which has been at least partially fixed by a fixing device of any other marking engine. In other embodiments, it is contemplated that fewer than all of the marking engines may be configured for serving as a second fixing device and/or that the pathways of the conveyor system 22 may permit fewer than all possible combinations of marking engines to be used as first and second fixing devices.

Figure 2:
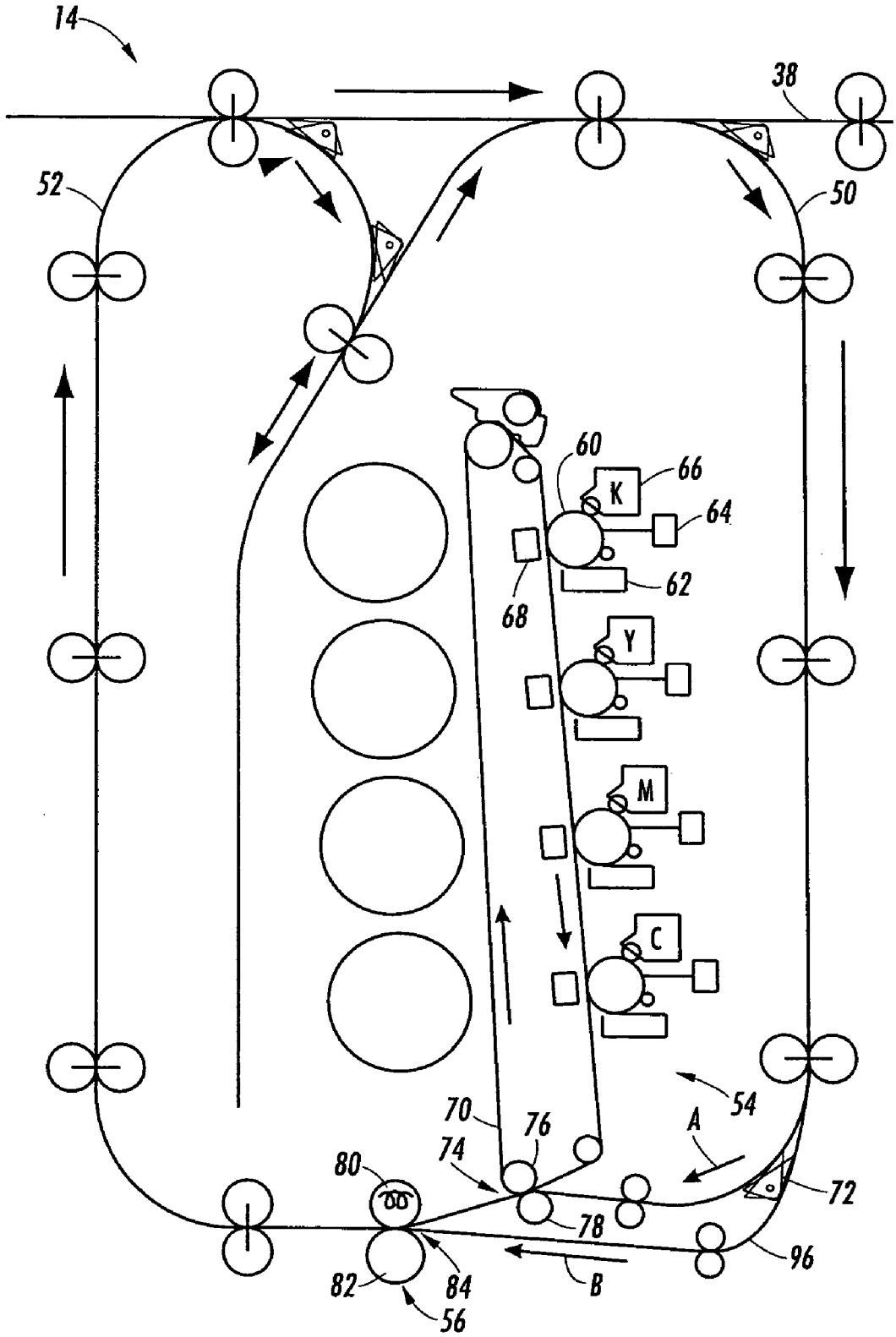
FIG. 2 is an enlarged schematic side view of one of the marking engines of FIG. 1.

With reference also to FIG. 2, which illustrates one of the marking engines 14, by way of example, the marking engines each include an image applying component 54, for applying an image to the print media, and a fixing device 56, for fixing the applied image to the print media. Marking engines 16 and 18 may be similarly configured. In the case of a xerographic marking engine, for example, the marking engine includes various xerographic subsystems for forming an image, transferring the image to a sheet of paper, and fusing the image to attach the image more permanently to the print media. The marking engine of a xerographic system typically includes a charge retentive surface, such as a rotating photoreceptor 60 in the form of a belt or drum. The images are created on a surface of the photoreceptor. Disposed at various points around the circumference of the photoreceptor 60 are the xerographic subsystems, which include a charging station 62 for one or more of the colors to be applied, such as a charging corotron, an exposure station 64, which forms a latent image on the photoreceptor, such as a Raster Output Scanner (ROS) or LED bar, a developer unit 66, associated with each charging station 62 for developing the latent image formed on the surface of the photoreceptor by applying a toner to obtain a toner image, a transfer unit 68, such as a transfer corotron, transfers the toner image thus formed to the surface of a print media substrate, such as a sheet of paper, or/to an intermediate transfer belt. In the illustrated embodiment, each of four toners cyan, magenta, yellow, and black (CMYK) is applied to a separate photoreceptor 60, and the resulting image transferred to an intermediate transfer belt 70. When the marking engine is operating in a normal marking and fixing mode, print media is directed by a switch 72 in pathway 50 to a transfer point defined by nip 74 between rollers 76, 78, as indicated by arrow A. At the transfer point 74, the print media is brought into contact with the intermediate transfer belt 70 for transfer of the image to the print media. Thereafter, the imaged print media is conveyed to the fixing device 56.

In an alternative embodiment (not shown) the charging station 62, exposure station 64, and developer unit 66 for each of the four toners are spaced around the same photoreceptor. In this embodiment, no intermediate transfer belt is required and the transfer point 74 can be the point at which the toner is transferred from the photoreceptor to the print media. A marking engine of this type is disclosed, for example, in above-mentioned copending application Ser. No. 11/137,251, incorporated herein by reference. In any particular embodiment of an electrophotographic marking engine, there may be variations on this general outline, such as additional corotrons, cleaning devices, and the like.

The fixing device 56, which is known as a fuser in electrographic printing systems, generally applies at least one of heat and pressure to the sheet to physically attach the toner and optionally to provide a level of gloss to the printed media. The illustrated fixing device includes a heated roller 80 and a pressure roller 82, which define a nip 84 therebetween through which the substrate passes. Fixing devices which apply ultraviolet radiation, or other radiation to fix the marking material to the substrate are also contemplated, as disclosed, for example, in copending U.S. application Ser. No. 11/168,152, filed Jun. 28, 2005, entitled "ADDRESSABLE IRRADIATION OF IMAGES," by Kristine A. German, et al., which is incorporated herein by reference in its entirety.

Figure 3:
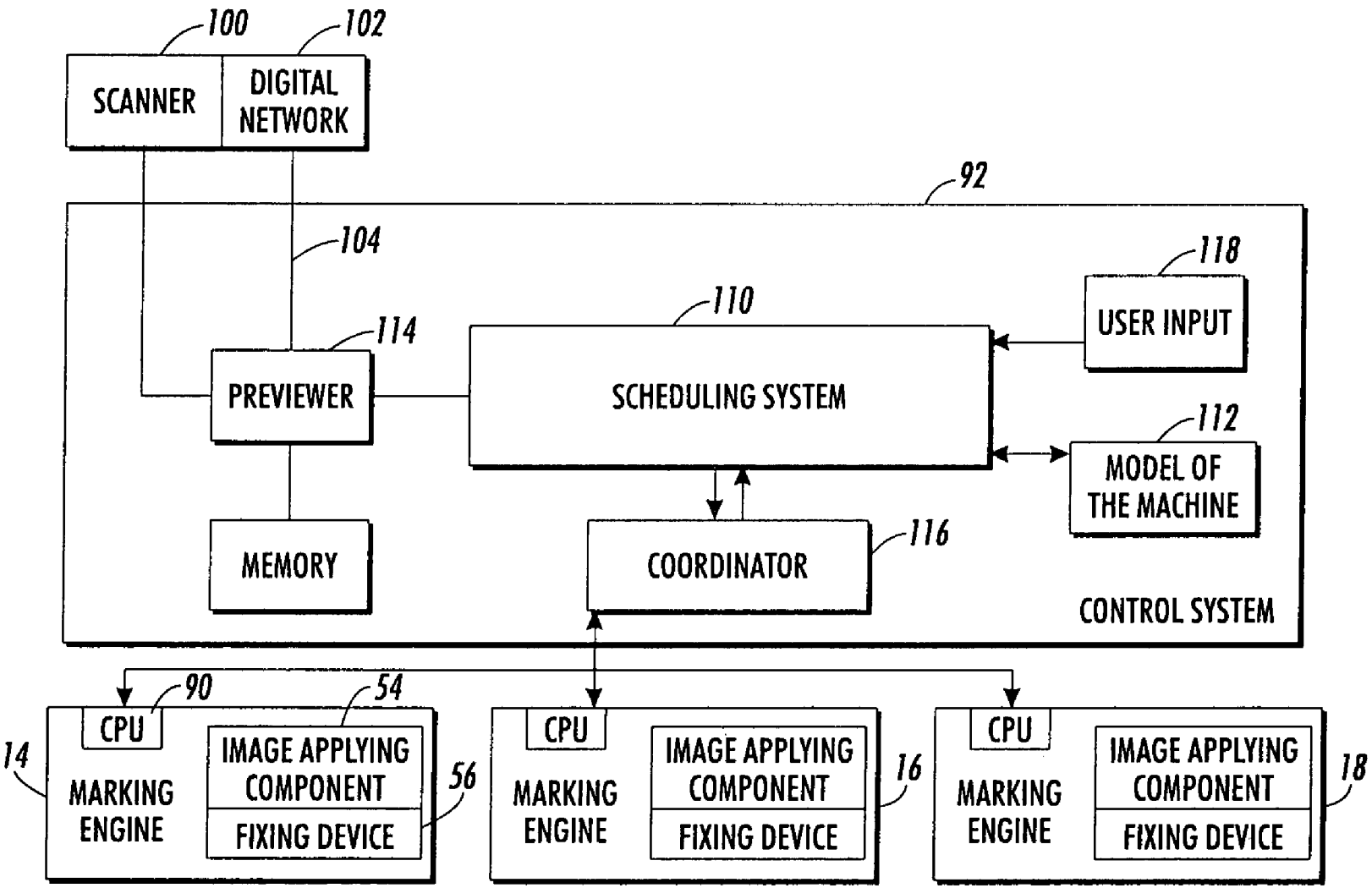
FIG. 3 is a block diagram of the printing system of FIG. 1 illustrating an exemplary control system.

The xerographic subsystems 62, 64, 66, 68 are controlled by a processing component, which may be located in the marking engine and/or elsewhere in the printing system 10. In the embodiment illustrated in FIG. 3, the processing component is distributed over the printing system and includes a marking engine controller 90 such as a CPU, associated with each marking engine 14, 16, 18, which includes actuators for controlling each of the subsystems, and an overall control system 92, which communicates with the individual marking engine CPUs 90 as described in greater detail below. The marking engine controller 90 is linked to the system controller 92 and may be also linked to other known components, such as a memory, a marking cartridge platform, a marking driver, a function switch, a self-diagnostic unit, all of which can be interconnected by a data/control bus. Each marking engine 14,16,18 may have its own marking engine controller 90, as shown in FIG. 3.

The printing system 10 is configured such that at least one of the fixing devices in the printing system is capable of serving as a secondary fixing device. For example, at a given time, the fixing device 56 of marking engine 14 may serve as a primary fixing device for print media marked by image applying component 54. The marked and at least partially fixed media is transferred by downstream highway 38 to the second marking engine 16 where no image is applied by the image applying component 94 (FIG. 1). However, the fixing device 95 of marking engine 16, acting in the capacity of a secondary fixing device, further fixes the image. It will be appreciated that the function of any marking engine may change over time such that at one time it operates in a marking and fixing mode and at another time in a fixing only mode.

In one embodiment, at least one of the marking engines 14, 16, 18 includes a bypass pathway 96 (FIG. 2) which allows the print media to bypass the transfer point 74. In the fixing only mode, the switch 72 is set so as to direct printed media which arrives from another marking engine via pathway 50 onto pathway 96 as indicated by arrow B. Pathway 96 connects pathway 50 directly with the fixing device 56, bypassing the transfer point 74. This facilitates operating the marking engine solely as a secondary fixing device. The movement of transfer belt 70 may be stopped or reduced while the marking engine functions as a secondary fixing device.

In another embodiment, in which bypass pathway 96 may be omitted, the transfer point 74 may be bypassed by spacing the transfer belt 70 from the paper pathway 50. For example, roll 78 may be lifted to bring the transfer belt 70 out of contact with roll 80, allowing the print media to pass by without contacting the transfer belt or with only a low pressure contact. This reduces the chance for partially fused toner to be transferred from the print media to the transfer belt 76 and allows movement of the transfer belt to be stopped.

In yet another embodiment, one or more of the marking engines 14, 16, 18 is capable of functioning as a secondary fixing device without modification to the paper paths.

The fixing devices 56, 95 of each of the marking engines may be substantially identical, or may be different due to machine to machine variations in nominally identical devices or due to differences in design and construction of the fixing devices. The differences in fusing capabilities may be comprehended by the printing system 10 and utilized in determining when to apply a secondary fixing treatment and which marking engine to utilize. In one aspect, the printing system includes at least one marking engine which has enhanced fixing capabilities. This marking engine can be used by the printing system as the secondary fixing device when the enhanced fusing capabilities are selected. In another aspect, differences in properties the fuser roll of the fixing device may be utilized. For example, a black marking engine typically has a hard fuser roll to provide an extended life where gloss of the images is not generally of concern, while a color marking engine may have a softer fuser roll for achieving a higher gloss, at the expense of a shorter life. Where high gloss black images are desired, the fixing device of a color printer may be used to increase the gloss.

When a marking engine 14, 16, 18 is operating in a fixing only mode, the marking engine controller 90 may communicate with one or more of the marking engine subcomponents 62, 64, 66, 68 to place the subcomponent in a mode adapted to reduce wear on the subcomponent and ensure that high quality prints can be generated once the marking engine returned to a marking and fixing mode. For example, periodic application of toner may be made from the developer housing 66 onto the photoreceptor 60 and cleaned therefrom to avoid degradation of the toner in the developer housing. Power to one or more of the subcomponents may be reduced. The transfer belt 70 may be stopped.

As illustrated in FIG. 3, an image input device supplies the printing system 10 with images to be printed. The image input device can be a built-in optical scanner 100 and/or digital network 102. The scanner can be used to scan a document such as book pages, a stack of printed pages, or the like, to create a digital image of the scanned document that is reproduced by printing operations performed by the printing system 10. A print job can be electronically delivered from the digital network 102, as illustrated in FIG. 3. The image input device 100, 102 communicates with the main control system 92 of the printing system 10. The digital network 102 may interconnect, for example, personal computers or other digital devices (not shown). For example, a network user operating word processing software running on a network computer may select to print a word processing document on the printing system 10, thus generating the print job, or an external scanner (not shown) connected to the network 102 may provide the print job in electronic form. While a wired network connection 104 is illustrated, a wireless network connection or other wireless communication pathway may be used instead or additionally to connect the printing system 10 with the digital network 102 or scanner 100. The digital network 102 can be a local area network such as a wired Ethernet, a wireless local area network (WLAN), the Internet, some combination thereof, or the like. Moreover, it is contemplated that print jobs may be delivered to the printing system 10 in other ways, such as by using an optical disk reader (not illustrated) built into the printing system 10, or by using a dedicated computer connected only to the printing system 10.

With continued reference to FIG. 3, the processing component of the printing system will be described in greater detail. The control system 92 includes a scheduling system 110, which includes various processing components for ordering print jobs into a queue and selecting appropriate marking engines and other components of the printing system 10 to perform the steps in generating each sheet. An example of one suitable scheduling system is described in copending U.S. application Ser. No. 11/137,251, filed May 25, 2005, entitled "SCHEDULING SYSTEM," by Robert M. Lofthus et al., which is incorporated herein by reference in its entirety. In selecting a suitable job order and processing components for a job, the scheduling system accesses a model of the machine 112 to obtain information on the printing system for scheduling jobs. In particular, the model of the machine may provide information on the functional characteristics of the marking engines, the current states of the marking engines, and their future availability. In this way, the scheduling system 110 can identify an available marking engine to be used for a secondary fixing of already marked sheets from those marking engines which are identified by the model 112 as having availability during the desired time period. Where more than one marking engine is available for performing the secondary fixing, the scheduling system may use inbuilt selection criteria and/or user input selection criteria to select a marking engine which best fits the criteria. For example, the scheduling system may select the least utilized marking engine or a marking engine which currently has no marking capability or one which has particular fixing characteristics.

In determining when to apply a secondary fixing treatment, the scheduling system may take into account such factors as:

1. Properties of the print media, such as the basis weight of the media to be printed, any coatings thereon, and surface properties, such as roughness. In such instances, the scheduling system may schedule a secondary fixing device for completing the fixing of such pages.
2. The number of sheets to be printed consecutively. If more than a maximum number of heavy weight sheets are to be fixed, for example, the temperature of the first fixing device may drop below an accepted level if run at normal operating speeds. In such instances, the scheduling system may employ a secondary fixing device to complete the fixing of the partially fused sheets.
3. Properties of the image, such as the estimated toner pile height. Fortoner pile heights above a certain level the first fixing device may not be able to fix the image at normal operating speeds. In such instances, the scheduling system may schedule a secondary fixing device for completing the fixing of such pages. The pile height may be estimated from the density of each toner to be overlapped in a given area of the image.
4. The specified gloss level to be achieved. When a high gloss is specified, a marking engine may not provide the desired gloss for the image at normal operating speeds. In such instances, the scheduling system may schedule a first fixing device to perform a partial fixing adequate to at least tack the image to the sheet, with the second fixing device achieving the desired gloss.
5. The state of a marking engine. While the exemplary embodiment is applicable to a fully functional system it finds application in systems where one or more marking engines is not functioning normally and has either a fixing shortfall or an image quality shortfall. In such instances, a marking engine which in general has good image quality function, but which is exhibiting a fixing shortfall, can be teamed with another marking engine having good fixing capability but which may be experiencing an image quality shortfall.

The scheduling system 110 receives information about the print job or jobs to be performed and proposes an appropriate route for the print media to follow in each of the jobs. The scheduling system confirms with each of the system components, such as marking engines, inverters, etc. that they will be available to perform the desired function, such as printing, inversion, etc., at the designated future time, according to the proposed schedule. Once the route has been confirmed in this way, any fuser temperature modifications are determined by the control system 92 and/or CPU 90 and the marking engine/fixing devices notified so the fixing device will be at the appropriate temperature when the print media arrives. Where the scheduling system has multiple jobs waiting in a queue, the scheduling system may order the jobs in the queue to minimize the time needed for fuser roll adjustments.

A job previewer or digital front end 114 in communication with the image input source 100, 102 reviews incoming jobs and sends information on the jobs to the scheduling system 110. This information may include the number of pages to be printed on each type of media, particularly identifying those pages to be printed on sheets of heavy weight media, rough paper, or coated paper, the image to be applied to each page of the sheet, and other information to be used in scheduling the printing of the print job.

The scheduling system 110 determines which, if any of the sheets are to undergo a secondary fixing treatment and assigns appropriate marking engines to perform the first and second fixing treatments, respectively. In making the assignment the scheduling system takes into account the availabilities of the marking engines and their fixing and other capabilities. The scheduling system may communicate with the marking engines and other components of the printing system via a coordinator 116, which coordinates the printing of the job including the transportation of the print media to the marking engines, the marking of media, the secondary fixing of selected media, where appropriate, and the collation and assembly of print jobs output by the finisher according to the scheduled itinerary.

A user input 118 optionally receives user inputs, such as user preferences, which affect job scheduling. The user input 118 may be connected to a suitable user input device (not shown) such as a keyboard, selector switch or the like. The user input 118 may be used to select between two or more modes which affect one or more of (1) whether a secondary fixing treatment is applied; (2) constraints on selection of a marking engine as the secondary fixing device. For example, the user may select between:

1. A normal (or default) mode, in which the scheduling system selects any available marking engine as a secondary fixing device only in instances where a single marking engine, under normal operating conditions, is unable to achieve a preselected level of attachment of the image to provide image permanence and/or a preselected minimum gloss level;
2. One or more user selected modes in which preselected criteria are used by the scheduling system in selecting a marking engine to be used as a secondary fixing device.

For example, where a user places a high importance on achieving a consistent gloss or a predefined (usually high) gloss level for a particular print job, the user may select a user selected gloss mode. In this mode, the scheduling system identifies a marking engine which best meets the criteria associated with the user selected gloss mode. In the gloss mode, the second fixing device may be used to achieve the consistent/selected gloss even though the first fixing device may provide adequate fixing for image permanence purposes and a gloss level or gloss consistency which is within acceptable limits as defined for the normal mode. Depending on the preselected criteria, the scheduling system 110 may delay the print job or make other changes to ensure that a marking engine which meets the selection criteria is available for performing the secondary fixing function.

The processing component, e.g., the model of the machine 112 or marking engine CPU 92, includes information or algorithms from which suitable adjustments to the set points of a fixing device which is to be used as the second fixing device can be determined. Set points which may be adjusted when a fixing device is to be used as a secondary fixing device include operating temperature, dwell time, and pressure set points. In general, the sheet temperature as it reaches a second fixing device depends on such factors as the temperature of the first fixing device, the time spent in travel between the first and second fixing devices, and the basis weight of the print media. Based on this information, adjustments may be made to one or more of the set points of the secondary fixing device to account for the heat provided by the sheet. Typically, a fuser can be set at a lower temperature when it is to be used as a secondary fixing device, thereby extending the useful lifetime of the device. Alternatively, the residual heat of a marked and fixed sheet may be utilized to achieve higher fixing or gloss without lowering the temperature set point of the second fusing device. In general, control of the fuser temperature set point to account for incoming media temperature allows a more accurate control of the gloss level of the image. In one aspect, part or all of the function of controlling the fuser set points may be assumed by the individual CPU 90 of the relevant marking engine. In this aspect, the control system 92 directs the marking engine to serve as a secondary fixing device and the marking engine's CPU 90 determines appropriate adjustments to the set points.

The model of the machine 112 is periodically updated with information on the current states of the marking engines 14, 16, 18, feeder 12, and finisher 20 by querying the marking engine CPU 90 (either directly or via the coordinator 116) and similar processing components in the feeder 12 and finisher 20.

In one embodiment, the feeder 12 includes sensors which detect paper properties, such as the weight, surface roughness, or gloss of paper in the trays 24, 26, 28, 30. This information is communicated to the model of the machine 112 and/or scheduling system 110. Alternatively, this information may be fed to the processing component by a user using the user input 118.

Various methods of scheduling print media sheets may be employed. For example, U.S. Pat. No. 5,095,342 to Farrell, et al.; U.S. Pat. No. 5,159,395 to Farrell, et al.; U.S. Pat. No. 5,557,367 to Yang, et al.; U.S. Pat No. 6,097,500 to Fromherz; and U.S. Pat. No. 6,618,167 to Shah; U.S. application Ser. Nos. 10/284,560; 10/284,561; and 10/424,322 to Fromherz, all of which are incorporated herein in their entireties by reference, disclose exemplary scheduling systems which can be used to schedule the print sequence herein, with suitable modifications.

It will be appreciated that. various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first marking engine comprising a first image applying component for applying an image to print media and a first fixing device for at least partially fixing the image applied by the first image applying component;

a second marking engine in series with the first marking engine, the second marking engine comprising a second image applying component and a second fixing device, the second marking engine being operable in a first mode of operation in which the second image applying component applies an image to print media and the second fixing device at least partially fixes the image applied by the second image applying component, the second marking engine being operable in a second mode of operation in which the second fixing device further fixes an image on the print media which has been applied by the first image applying component and fixed by the first fixing device without an intermediate application of an image to the print media by the second image applying component; and a processing component which controls the second marking engine to operate in a selected one of the first and second modes of operation.

2. The printing system of claim 1, wherein the second marking engine further comprises a bypass pathway whereby print media with images which have been applied by the first image applying component and fixed by the first fixing device bypass the second image applying component in the second mode of operation.

3. The printing system of claim 1, wherein the first marking engine is operable in both a first mode of operation and second mode of operation, in the first mode of operation, the first image applying component applies images to print media and the first fixing device fixes the images applied by the first image applying component, in the second mode of operation, the first fixing device further fixes images which have been applied by the second image applying component and fixed by the second fixing device.

4. The printing system of claim 1, wherein the processing component determines whether to operate the second marking engine in a selected one of the first and second modes based on at least one of:

a property of the print media to be printed;

a number of sheets to be printed consecutively on the first marking engine;

an estimate of toner pile height of the image;

a selected gloss level of the image; and a shortfall in fixing capacity of the first marking engine.

5. The printing system of claim 1, wherein in the second mode of operation, the processing component identifies the second marking engine from a plurality of available second marking engines based on at least one selection criterion.

6. The printing system of claim 1, wherein the processing component determines a setpoint for the second fixing device for the second mode of operation which differs from a setpoint for the second fixing device for the first mode of operation.

7. The printing system of claim 6, wherein the setpoint includes at least one of the group consisting of a temperature setpoint, a dwell time set point, and a pressure setpoint.

8. The printing system of claim 1 wherein the first image applying component is of a different print modality from the second image applying component.

9. A method of marking print media comprising:

applying an image to print media with a first image applying component and at least partially fixing the image with an associated first fixing device; and further fixing the applied and at least partially fixed image with a second fixing device associated with a second image applying component configured for selectively applying images to print media, without an intermediate application of an image to the print media by the second image applying component.

10. The method of claim 9, further comprising:

directing the print media with the applied and at least partially fixed image to a bypass pathway which bypasses the second image applying component.

11. The method of claim 9, further comprising:

conveying the print media between the first and second fixing devices on a print media conveyor.

12. The method of claim 9, further comprising:

determining whether to further fix the print media with the applied and at least partially fixed image based on at least one of:

a property of the print media to be marked;

a number of sheets of the print media to be fixed consecutively on the first fixed device;

an estimate of toner pile height of the image;

a selected gloss level of the image; and a shortfall in fixing capacity of the first fixing device.

13. The method of claim 9, further comprising:

selecting the second fixing device from a plurality of available second fixing devices based on at least one selection criteria.

14. The method of claim 9, further comprising:

adjusting a setpoint of the second fixing device from a first setpoint for fixing unfused images to a second setpoint for further fixing the image on the print media which has been applied by the first image applying component and fixed by the first fixing device.

15. The method of claim 9, further comprising:

in a first mode of operation, applying a second image to print media with the second image applying component and fixing the second image with the second fixing device; and in a second distinct mode of operation, with the second fixing device, further fixing the image applied by the first image applying component and at least partially fixed by the first fixing device.

16. The method of claim 15, further comprising:

in the first mode of operation, the application of the second image to print media with the second image applying component and the fixing of the second image with the second fixing device are performed generally contemporaneously with applying the first image to print media with the first image applying component and fixing the first image with the first fixing device.

17. The method of claim 9, wherein the second fixing device increases at least one of:

the gloss of the image applied by the first image applying component and at least partially fixed by the first fixing device; and the permanency of the image.

18. The method of claim 9, wherein the print media is outside the latitude limits of the first fixing device.

19. The method of claim 9, wherein the first fixing device effects only a partial fixing of the image.

20. A printing system comprising:

a first marking engine comprising a first image applying component for applying an image to print media and a first fixing device for at least partially fixing the image applied by the first image applying component;

a second marking engine in series with the first marking engine, the second marking engine comprising a second image applying component for applying an image to print media and a second fixing device for at least partially fixing the image applied by the second image applying component, and a bypass pathway whereby the second image applying component is selectively bypassed for further fixing an image on the print media which has been applied by the first image applying component and fixed by the first fixing device.

21. The printing system of claim 20, further comprising:

a processing component which selectively controls a switch which routes the print media to the bypass pathway.

* * * * *